United States Patent [19]

Ueda et al.

[11] Patent Number: 4,935,775

[45] Date of Patent: Jun. 19, 1990

[54] AUTOMATIC DOCUMENT FEEDER WITH AN IMAGE AREA DESIGNATING DEVICE FOR DUPLEX COPYING

[75] Inventors: Noriyoshi Ueda, Yokohama; Makoto Kitahara, Tokyo; Masaaki Sato, Yokohama, all of Japan

[73] Assignee: Canon Kabushiki Kaisha, Tokyo, Japan

[21] Appl. No.: 100,452

[22] Filed: Sep. 24, 1987

[30] Foreign Application Priority Data

| | | | |
|---|---|---|---|
| Sep. 30, 1986 | [JP] | Japan | 61-231962 |
| Sep. 30, 1986 | [JP] | Japan | 61-231963 |
| Sep. 30, 1986 | [JP] | Japan | 61-231964 |
| Sep. 30, 1986 | [JP] | Japan | 61-231966 |

[51] Int. Cl.[5] ..... G03G 21/00

[52] U.S. Cl. ..... 355/202; 355/313; 355/320

[58] Field of Search ..... 355/3 SH, 7, 14 SH, 355/75, 202, 218, 309, 313, 318, 319, 320

[56] References Cited

U.S. PATENT DOCUMENTS

| | | | |
|---|---|---|---|
| 4,140,387 | 2/1979 | Gustafson | 355/14 SH |
| 4,215,929 | 8/1980 | Sato et al. | 355/218 |
| 4,231,561 | 11/1980 | Kaneko et al. | 355/3 SH X |
| 4,264,067 | 4/1981 | Adams et al. | 355/3 SH X |
| 4,544,148 | 10/1985 | Kitajima et al. | 271/3.1 |
| 4,582,417 | 4/1986 | Yagasaki et al. | 355/218 |
| 4,615,607 | 10/1986 | Yanagawa et al. | 355/326 |
| 4,660,957 | 4/1987 | Ueda et al. | 355/313 |
| 4,707,126 | 11/1987 | Ohshima et al. | 355/218 |
| 4,740,818 | 4/1988 | Tsilibes et al. | 355/7 X |
| 4,761,001 | 8/1988 | Hayakawa et al. | 271/3.1 |
| 4,812,874 | 3/1989 | Kubota et al. | 355/202 |
| 4,829,341 | 5/1989 | Sasaki et al. | 355/313 X |
| 4,849,787 | 7/1989 | Honjo et al. | 355/313 |

FOREIGN PATENT DOCUMENTS

| | | |
|---|---|---|
| 81865 | 7/1981 | Japan . |
| 57-204066 | 12/1982 | Japan . |
| 204066 | 12/1982 | Japan . |
| 58-190959 | 11/1983 | Japan . |
| 59-77768 | 5/1984 | Japan . |
| 61-3182 | 1/1986 | Japan . |
| 62-35337 | 2/1987 | Japan . |
| 62-50840 | 3/1987 | Japan . |

*Primary Examiner*—Fred L. Braun

*Attorney, Agent, or Firm*—Fitzpatrick, Cella, Harper & Scinto

[57] ABSTRACT

An automatic document feeder includes a first original supporting device for supporting an original, the first original supporting device being provided with a digitizer for designating such an area in the original as to be recorded, first original feeding device for feeding the original from the digitizer, second original supporting device for supporting an original, second original feeding device for feeding the original from the second original supporting device, conveying device for introducing the original fed by the first or second feeding device to an original reading station and thereafter discharging the original from the reading station, and control device for controlling the conveying device to inverse in a face orientation the original fed by the first feeding device and then to discharge it to the digitizer, while to inverse in a face orientation the original fed by the second feeding device and then to return it to the reading station.

17 Claims, 12 Drawing Sheets

AUTOMATIC DOCUMENT FEEDER WITH AN IMAGE AREA DESIGNATING DEVICE FOR DUPLEX COPYING

FIELD OF THE INVENTION AND RELATED ART

The present invention relates to an automatic original or document feeder usable with an image forming apparatus such as a copying machine or information recording machine, more particularly to an automatic document feeder equipped with a coordinate position detecting device, which hereinafter will be called "digitizer", for instructing an area in an image of the original to be copied or recorded.

Some image forming machines are used with an automatic document feeder to automatically and/or continuously feed originals to be copied to a predetermined station of an image reading station. On the other hand, some modern machines are used with a digitizer device to designate such a selected area of an original as is copied or as is omitted from a copy.

Some of conventional digitizer devices are located above a platen glass cover in copying machines, as disclosed in U.S. Pat. No. 4,812,874, issued Mar. 14, 1989. With those machines, after the copy area is set using the digitizer, the cover is manually opened, and then the original is placed again on the platen glass. This is cumbersome.

In order to solve this problem, it has been proposed in U.S. Pat. No. 4,829,341issued May 9, 1989 and U.S. Ser. No. 051,369, filed May 19, 1987, now abandoned, that the digitized device is formed integral with the document feeder at its upper portion, and that an original feeding inlet is provided particularly for the digitizer device in addition to an original inlet for the document feeder.

Further, when the copy area instruction is effected to both sides of an original in a conventional automatic document feeder, a copy area is first designated by the digitizer in the first side of the original, and then the original is fed to an original reading station, where the first side is copied within the designated area; and thereafter, the operator manually inverses the original in its facing orientation and places it with the second side face up on an original placing plate of the digitizer device to designate the copy area for the second side.

Therefore, when the copy areas are to be designated on both sides of an original, the process includes the copy area designation for the first side, the image forming operation, and the placing back of the original to an original reference position of the digitizer device by the operator with the operator's judgement with respect to the original positioning including front-back sides, top-bottom sides and right-left sides or the like. The last mentioned operator's operation is also cumbersome.

Further in the automatic document feeder described above the original is discharged opposed to or toward an original feeding inlet of the digitizer device when it is discharged after image formation after it is fed from the inlet of the original feeding device or when it is discharged after image formation after it is fed from the digitizer device. Therefore, the sheet having been discharged is liable to unintentionally reach the original inlet of the digitizer device, with the result that the image forming operation continues endlessly, particularly when the original has a large size. When, on the contrary, the original has a small size, the original, when discharged, is stopped far away from the original inlet (an original reference position), since the structure is such that the original is discharged toward the original inlet of the digitizer. This results in a rather poor operativity when the digitizer is used to designate the copy areas for both sides of the original as described above, since the discharged original has to be moved all the way to the original inlet to correctly position it.

SUMMARY OF THE INVENTION

Accordingly, it is a principal object of the present invention to provide an automatic document feeder with a digitizer, by which copy or reading areas of a duplex original can be correctly and easily performed.

It is another object of the present invention to provide an automatic document feeder with a digitizer, wherein the possibility of erroneous operation is removed or minimized even when the original is relatively long.

It is a further object of the present invention to provide an automatic document feeder with a digitizer wherein the copy or reading area can be quickly designated when the designation is performed repeatedly on the same size sheet.

According to an embodiment of the present invention, after one side of an original is read, the original is inverted in its facing orientation and is returned onto the digitizer, automatically. Therefore, the original is placed back onto the digitizer with its facing orientation inversed, so that the reading area designation is easily, quickly and correctly effected for duplex originals.

According to an embodiment of the present invention, an original outlet from the digitizer (original inlet to a reading station) in a digitizer mode is located at the same side of the document feeder as an original inlet to the digitizer (return port). Therefore, the original is placed back adjacent to the inlet (outlet), so that the reading area designating operation can be effected continuously. Also, even when an automatic starting mechanism is used, the original is not unintentionally fed.

According to an embodiment of the present invention, there is provided a curved sheet passage, so that the original can be placed face up and can be discharged face up, and therefore, the manipulation using the digitizer is made easier, and the original can be placed in natural order.

According to an embodiment of the present invention, the original placing plate is located above the reading station, so that the area occupied by the apparatus is minimized.

According to an embodiment of the present invention, the original supporting platen is used also as a cover for the digitizer, thus reducing the cost.

According to an embodiment of the present invention, the digitizer is movable (openable), so that a larger space can be utilized for discharging the original, and therefore, a larger number of originals can be handled.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
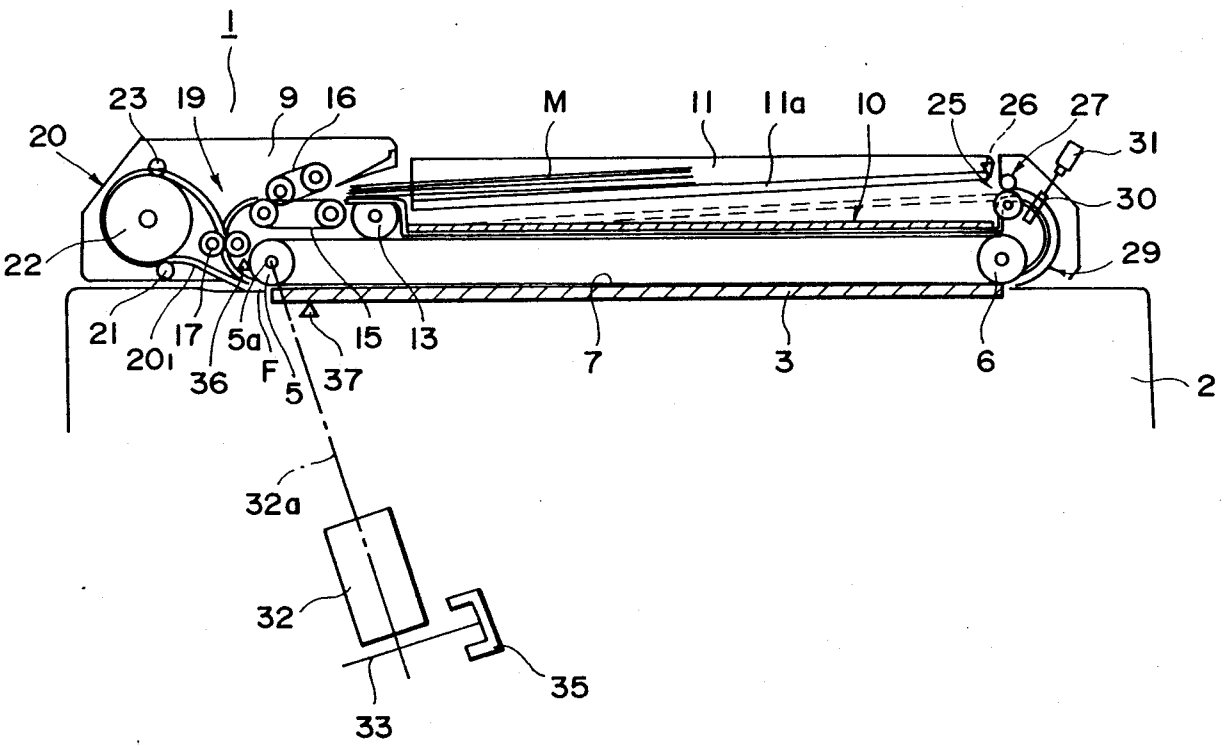
FIG. 1 is a sectional front view of an automatic document feeder according to an embodiment of the present invention.
Figure 2:
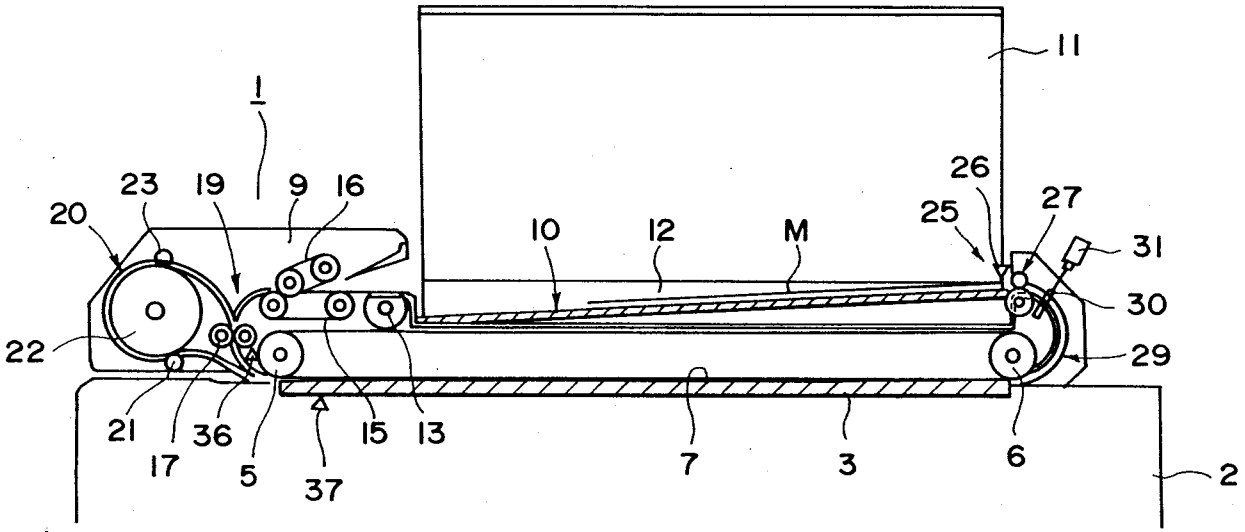
FIG. 2 is a sectional front view of the automatic document feeder with its cover opened.

Referring to FIG. 1, there is shown an automatic document feeder 1 according to an embodiment of the present invention. The document feeder 1 is disposed above an image forming apparatus which is shown as a copying machine 2 in this Figure. The document feeder includes an original conveying means in the form of a whole surface belt 7 which is trained around and between a driving roller 5 and a follower roller 6 and which is faced to a platen glass 3 of the copying machine 2. The driving roller 6 has a shaft 5*a* which is operatively connected with a shaft 32*a* of a reversible motor 32. To the other end of the shaft 32*a* a clock disk 33 is fixed. Opposed to the clock disk 33 is disposed a photointerruptor 35, which functions to detect and count the number of slits formed in the clock disk 33 to control amount of movement of the whole surface belt 7. Above the belt 7 and above the main body 9 of the document feeder 1, there is provided a digitizer 10 for designating an area of the image on an original M.

Figure 6:
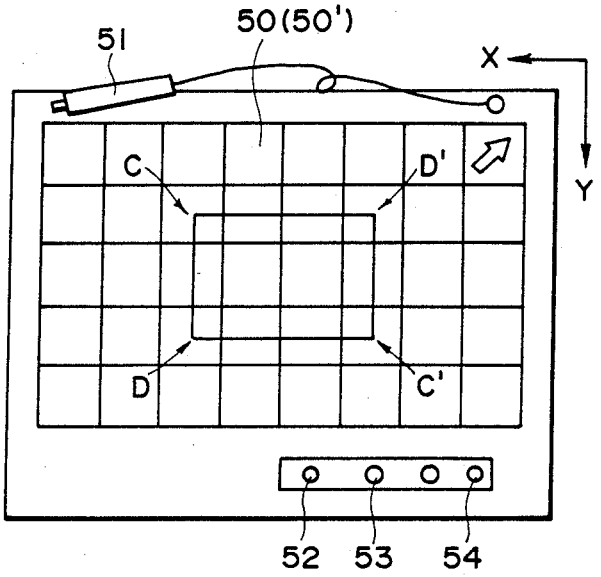
FIG. 6 is a top plan view of the digitizer.

As shown in FIG. 6, the digitizer 10 includes two resistor plates 50 and 50′ for reading a lateral (X) direction and a longitudinal (Y) direction and a read pen 51. When an operator pushes points representative of the area which the operator wants to designate, the resistor plates (digitizer) produce a voltage corresponding to the position, and the voltage is sensed as the set area information. The resistor plates (digitizer) are wide enough to cover a clear key 52, registration key, continuous mode selector key 54 and the like, in addition to the space required for supporting an original. Therefore, the operator can depress the key or keys by the read pen 51 to input the intended instructions.

Referring back to FIG. 1, an original placing reference position on the platen glass 3 of the copying machine is the position of a sensor 37 adjacent the left end of the platen glass 3 and at the rear side (FIG. 1 is a front view). Therefore, a reference position of the digitizer 10 is set at the upper right corner (FIG. 6). This is adjacent a roller 27 which will be described hereinafter.

The main body or assembly 9 of the document feeder is provided with an original feeding tray 11 which also functions as a cover for protecting the entire surface of the digitizer 10. The feeding tray 11*a* has an original stacking table 11*a*.

The digitizer 10 is provided with an original inlet 25 to the original reading station (platen glass at the right side. Adjacent the inlet 25, there is provided a sensor 26 for detecting the original M being fed through the inlet 25. Downstream of the sensor 26 is disposed a couple of feed-discharge rollers 27 which operates in accordance with detection signals by the sensor 26 when the digitizer is used and which discharges the original M conveyed by the whole surface belt 7 when only the automatic document feeder 1 is used. Downstream of the rollers 27 are curved guiding plates 29 to form a curved sheet passage, which is provided with a stopper 30. The stopper 30 is actuatable by a solenoid 31 to temporarily stop the original M and refeed it in a timed relation with the operation of the copying machine 2. The rollers 27 may be in the form of a reversible slip roller couple, which slips on the original when the leading edge of the original abuts the stopper 30, so that an oblique conveyance of the original is corrected. The rollers 27 may be in the form of usual rollers, and in this case, a loop of the original is formed by the leading edge abutting the stopper 30.

The document feeder 1 further includes, adjacent a left side of the tray 11, original feeding rollers 13 for feeding one by one the originals M on the original feeding tray 11 (an original stacking means) from the bottom, a conveying belt 15 for conveying an original M by its counterclockwise rotation, a separation belt 16 for singling out an original M by its counterclockwise rotation, a couple of conveying rollers 17 for conveying an original M and a sensor 36 for detecting a leading and a trailing edges of an original M. By those means, a feeding mechanism 19 is constituted to feed the original M to an original placing reference position 37 on the platen 3. When an original is placed on the platen 3 with its edge in alignment with the reference 37, it is placed at a reading position. The feeding mechanism 19 is connected with an original inversing passage 20 for inversing the original M in its facing orientation. The inversing passage 20 is equipped with an inversing roller 21, a large inversing roller 22 and another inversing roller 23.

Figure 3:
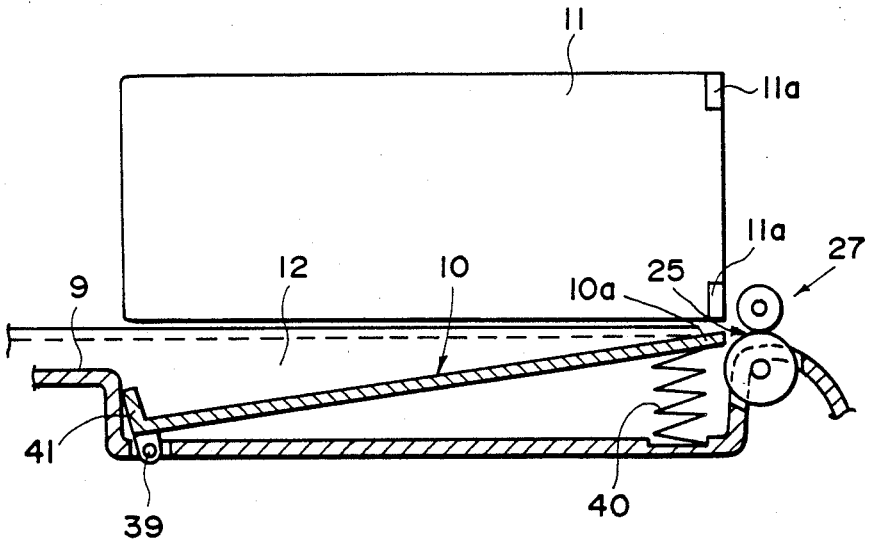
FIG. 3 is a top plan view of a major part of a digitizer.

Referring to FIG. 3, the digitizer 10 is rotatable about a hinge 39 adjacent its left end, while the right end portion is normally urged upwardly by a spring 40. The digitizer further includes a stopper 41 adjacent its left ends, which is effective to maintain the right edge 10*a* of the digitizer at the same level as the inlet 25.

Figure 4:
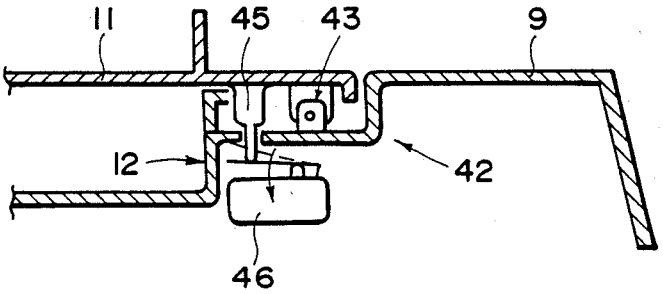
FIG. 4 is a sectional side view of a portion for mounting a feeding tray.
Figure 5:
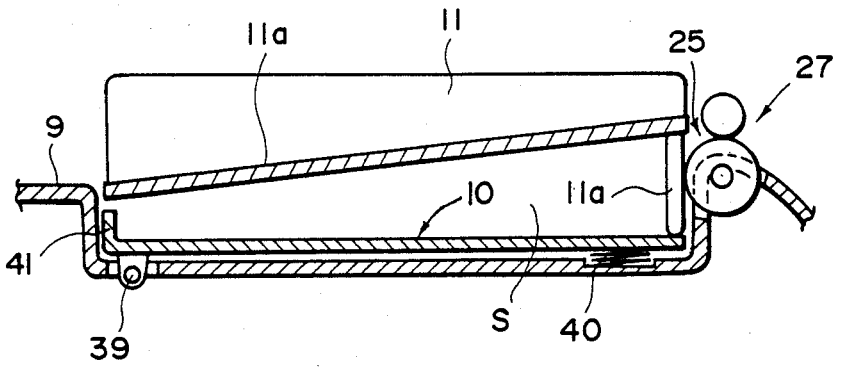
FIG. 5 is a front sectional view of the automatic document feeder with the digitizer at its lower position.

Referring to FIGS. 3, 4 and 5, the feeding tray 11 is mounted rotatably about a hinge 43 on a horizontal portion of a step 42. A vertical portion of the step 42 constitutes a reference wall 12 at the rear side of the document feeder 1 (FIG. 4 is a sectional side view). A projection 45 is formed extending from the tray 11 downwardly at a position inside of the hinge 43. The projection 45 operates a microswitch 46 of the main assembly of the document feeder 9 in association with opening and closing of the feed tray 11. As shown in FIG. 3, the feed tray 11 has projection 11*a* at upper right and bottom right portions thereof (when the tray 11 is opened). The projections 11*a* are projected downwardly from the bottom of the tray 11 when the tray is closed, so that they press down the digitizer 10 toward the main assembly 9 of the document feeder when the tray 11 is closed.

In operation, when the copy area is not to be designated, that is, when the digitizer 10 is not used, the feed tray 11 (which also functions as a cover for the digitizer 10) is closed. Then, the projection 43 closes the microswitch 46 for the document feeder to detect that the tray 11 is closed, in response to which the document feeder is set in non-digitizing mode. In this mode, the digitizer 10 is rotated downwardly about the hinge 39 to be closed to the main assembly 9, by which a sufficient original discharging space S is formed below the original stacking table 11*a* of the tray 11, as shown in FIG. 5.

When a start key (not shown) of the copying machine 2 is actuated, the feeding roller 13 starts to rotate to feed the bottommost original M of this original stack on the stacking table 11*a*. The originals M are fed from the bottom one by one by the conveying belt 15 and the separating belt 16. The original M is conveyed by the conveying roller 17 and is inserted between the whole surface belt 7 and the platen 3. Then, the original M is placed on the platen by the belt 7 such that its trailing edge is in alignment with the reference 37 on the platen 3, and then the original M is read by a reading means of the copying machine 2. After it is read, it is advanced rightwardly by the whole surface belt 7 driven by the driving roller 5, and further through the curved passage 29 to be gripped and discharged by the feed-discharge roller couple 27 into the space S above the digitizer 10.

When the copy area is to be designated on the original M, the feed tray 11 is first opened upwardly. Then, the projection 45 opens the microswitch 46, in response to which the document feeder detects that the feed tray 11 is open, and simultaneously, the digitizing mode is set. At this time, the right side of the digitizer 10 is released from the projections 11*a* and 11*a* of the tray 11, so that the digitizer 10 is allowed to rotate upwardly by the spring 40, by which the right edge of the digitizer 10 is placed at the same level as the inlet 25, as shown in FIG. 3. Then, the original M is placed face up on the resistor plate (50, 50') and is positioned such that the upper right corner of the original is in alignment with the upper right reference of the digitizer 10 (when the digitizer 10 is seen from the top). Then, the operator designates the area which the operator likes to copy by depressing points C and C' or D and D', for example, by the read pen 51, as shown in FIG. 6. Subsequently, the operator depresses the registration key 53 by the read pen 51, by which the reading area is set. Then, the operator manually advances the original M with its rear edge in abutment with the reference wall 12. When the leading edge of the original M is detected by the sensor 26, the feed-discharge roller couple 27 starts to rotate to feed the original M to the stopper 30. When the stopper 30 is retracted from the passage by the solenoid 31 in timed relation with the operation of the copying machine 2, the original M is advanced and guided by the curved passage 29 to the reference position 37 on the platen 3, to which the leading edge of the original M is aligned. Subsequently, the copying machine 2 operates to copy only the designated area of the original M on the basis of the information registered. After the original is read, it is conveyed back rightwardly by a reversed rotation of the whole surface belt 7 and is guided by the curved guide 29. Finally, it is gripped and conveyed by the feed-discharge roller couple 27 back onto the digitizer 10.

Figure 7:
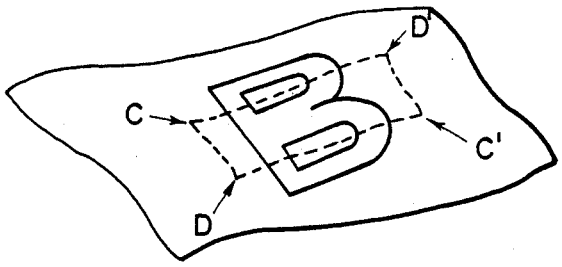
FIGS. 7 and 8 show an original and a copy taken therefrom using a digitizer.
Figure 8:
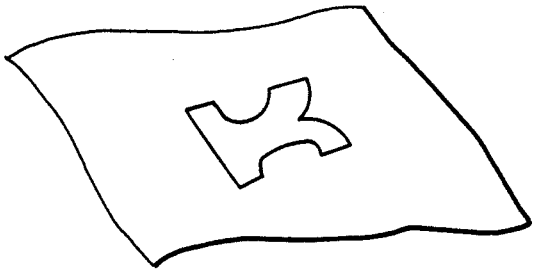
Figure 9:
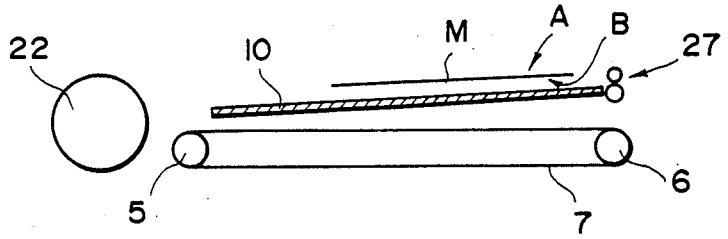
FIGS. 9–16 are somewhat schematic front views illustrating conveyance of an original.

Referring to FIGS. 7 and 8, the digitizer 10, for example, is used to designate the area to be copied by designating the points C and C', or D and D' in FIG. 7. Then, the resultant copy is as shown in FIG. 8 without any image outside the designated area.

When a non-digitizing duplex mode is selected, the first side of the original M is copied in the same manner as in the simplex copying mode. Thereafter, the original M is conveyed back leftwardly by the whole surface belt 7, and is introduced into the inversing passage 20 through the passage $20_1$. To allow this, a flapper means F is disposed at a merging position between the passages 19 and $20_1$ to switch the moving passage of the original M. The original M is gripped and conveyed between the inversing roller 21 and the large inversing roller 22 and then between the inversing roller 23 and the large inversing roller 22 through the inversing passage 20 back to the conveying roller couple 17, which then inserts the inversed original between the whole surface belt 7 and the platen 3. Thus, the original M is placed on the platen 3 with its unread side facing down in alignment with the original placing reference 37 on the platen 3, and then the original M is read again by the copying machine 2. Subsequently, the original M is advanced rightwardly and further advanced through the curved passage 29 to be gripped and conveyed by the feed-discharge roller couple 27 back onto the digitizer 10. Thus, the duplex copy of the original M is completed.

Figure 10:
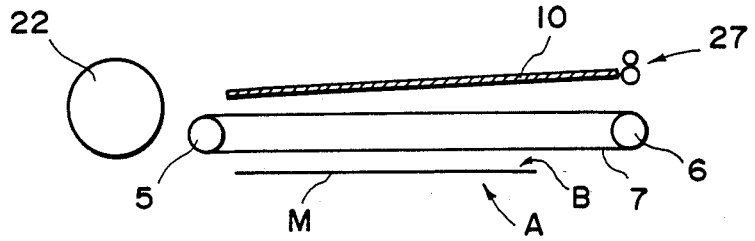
Figure 11:
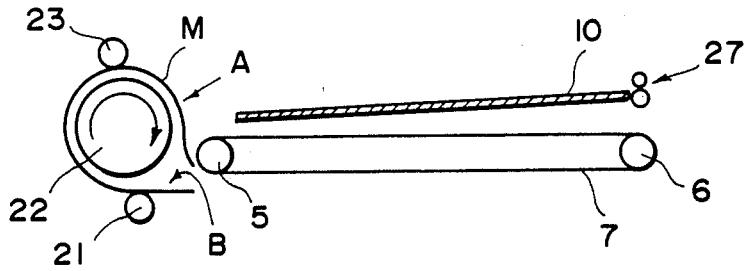
Figure 12:
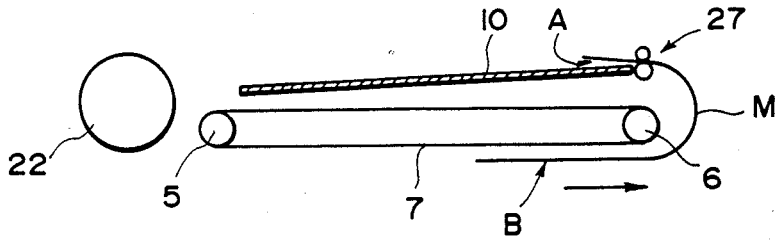
Figure 13:
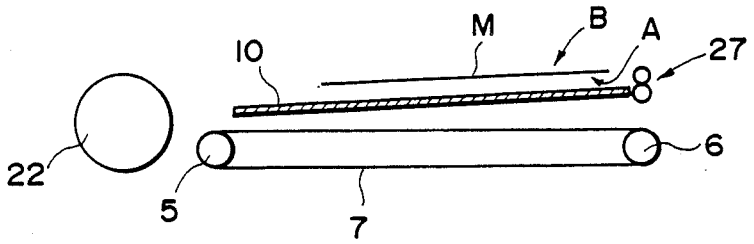
Figure 14:
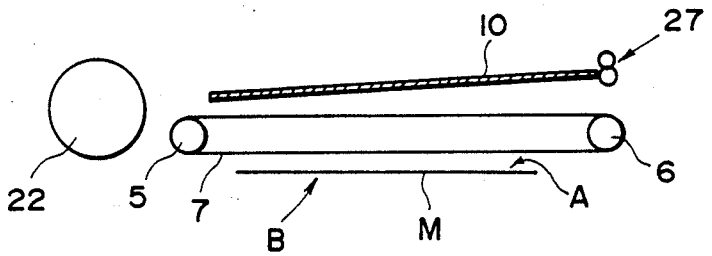
Figure 15:
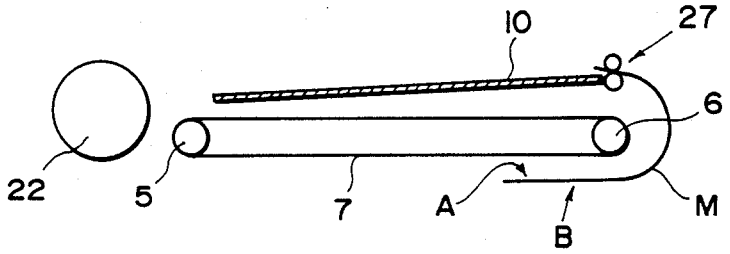
Figure 16:
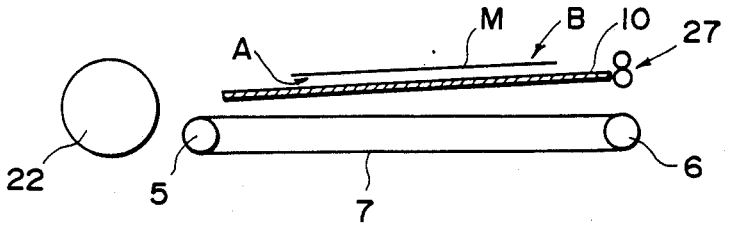

Referring to FIGS. 9–16, the operation will be described when the digitizing duplex mode is selected. The original M is placed on the digitizer 10 with its first side A facing up, and the copy area is designated in the same manner as described above (FIG. 9). Then, it is fed toward the reading station in timed relation with the operation of the copying machine 2 by cooperation between the feed-discharge roller couple 27 and the stopper 30, and then is positioned in place on the platen 3 by the whole surface belt 7 in alignment with the original reference position 37. Subsequently, the first side A of the original is read by the copying machine 2 (FIG. 10). Then, the original M having been copied at its first side A is advanced further leftwardly by the whole surface belt 7 to the inversing passage 20, where it is conveyed between the inversing roller 21 and the large inversing roller 22 and further between the large inversing roller 22 and the inversing roller 23, as shown in FIG. 11. The original M is then conveyed rightwardly by the whole surface belt 7 to such an extent that it is gripped by the feed-discharge roller couple 27, as shown in FIG. 12. Then, the original M is discharged onto the digitizer 10 with its second face B facing up, as shown in FIG. 13. On the digitizer, the original M is subjected to the copy area designating operation for the second side B, and thereafter, it is manually advanced to the feed-discharge roller couple 27. The roller 27 cooperates with the stopper 30 to feed the original M in timed relation with the operation of the copying machine. The original M is then positioned in alignment with the original reference position 37 on the platen 3 by the whole surface belt 7, whereafter the second side B is copied by the copying machine 2, as shown in FIG. 14. The original M having been copied at its second side B in addition to the first side A, is advanced rightwardly by the whole surface belt 7 to be gripped by the feed-discharge roller couple 27, as shown in FIG. 15. It is discharged onto the digitizer 10 with its second side B facing up, as shown in FIG. 16. In this manner, both sides A and B of the original M are copied only in the respective designated areas.

Figure 18:
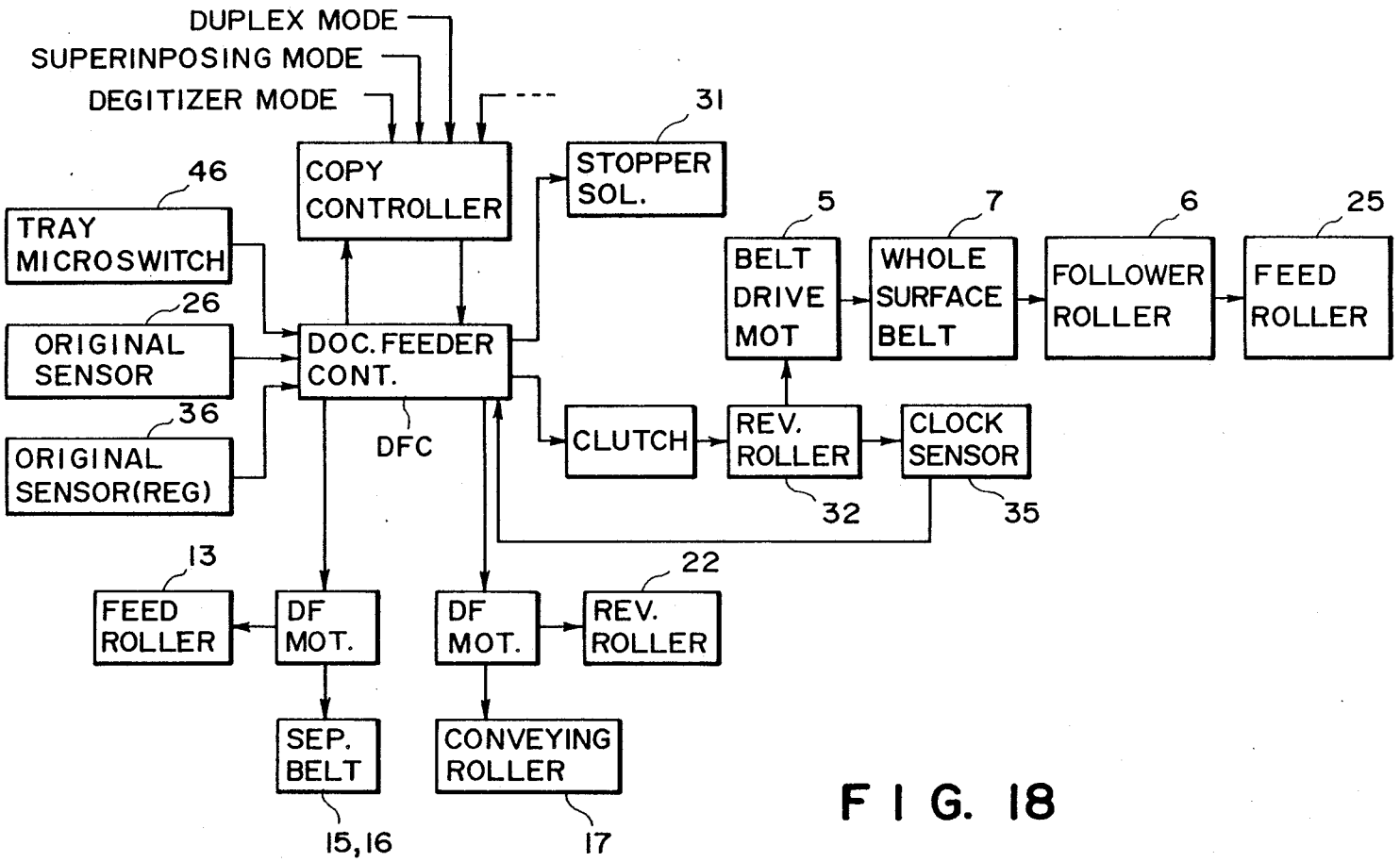
FIG. 18 is a block diagram for a control system.

FIG. 18 shows an example of a control system for returning an original M to the digitizer after its face is inversed after one face thereof is read. As will be understood from this Figure, the inversing mechanism, the belt 7 and the roller 27 are controlled on the basis of the information inputted into the document feeder controller DFC and to the controller of the copying apparatus.

Figure 17:
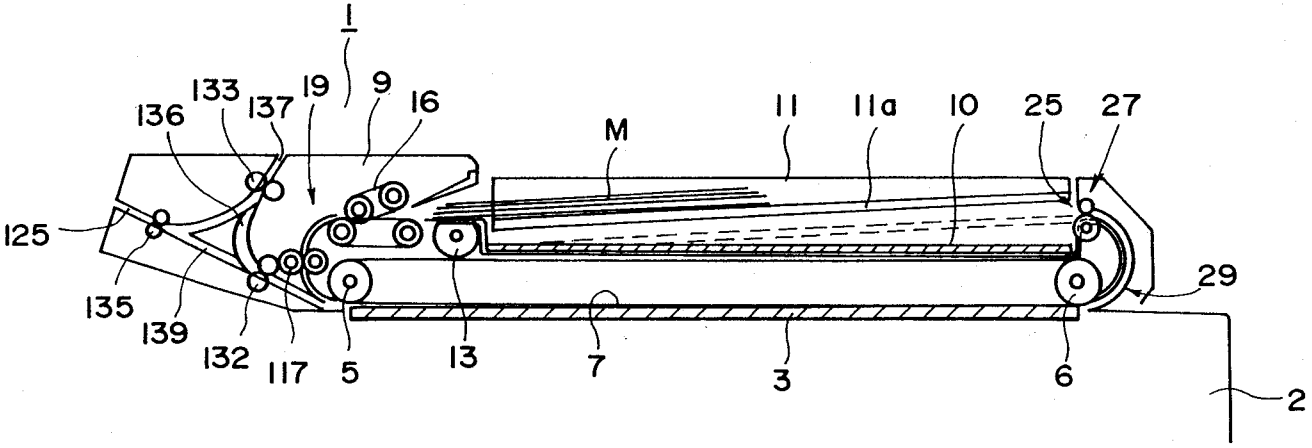
FIG. 17 is a front sectional view according to another embodiment of the present invention.

In the foregoing embodiment, the inversing mechanism includes a large inversing roller 22 around which the original is conveyed through almost one full turn. However, the present invention is not limited to this arrangement. Referring to FIG. 17, there is shown an alternative inversing mechanism which uses a switch-back mechanism. This alternative inversing means includes conveying rollers 132 and 133, a switch back roller 135 and passages 136, 137 and 139 to constitute the switch-back mechanism. By the switch-back type inversing means, an original M is conveyed to the passage 136 above the conveying rollers 132 and 133. When the trailing edge of the original M is passed through the passage 136 and is introduced into the passage 137, the conveying roller 133 is switched to a reversed rotation so that the original M is conveyed to the switch-back roller 135. When the trailing edge of the original M is introduced into the passage 125 by the roller 135, the roller 135 is switched again back to the normal rotation, so that the original M is conveyed reversely through the passage 139 to the conveying roller 132. By the roller 132, the original M is conveyed to the whole surface belt 7, and further, it is discharged onto the digitizer 10 by the belt 7 and the feed-discharge roller 27 with its second face B facing up.

In the foregoing embodiment, the copy area designation for the second side B is performed after the first side A thereof is copied after the copy area therefore it designated. However, the copy areas for the first and second sides A and B may be continuously designated. In this case, the copy area for the first side A is first designated, and then the original is inversed in its facing orientation, whereafter the copy area for the second side B is designated; and then the original is again inversed in its facing orientation to face the first side up, and then conveyed to the feeding roller 27. By doing so, a copy or copies having copies of designated areas of both sides A and B of the original can be obtained by a single insertion of the original. That is, after the first side is read, the original is inversed by the inversing mechanism whereafter the second side is read, and finally discharged onto the digitizer 10.

In the foregoing embodiments, the original M is discharged onto the digitizer 10 with the second face facing up after the second side is copied. However, the original M may be inversed again (idling conveyance) to discharge it with its first face facing up.

In the foregoing embodiments, after the copy area is designated by the digitizer 10, it is manually advanced to the feed-discharge roller couple 27. However, this may be effected automatically, by for example, employing a feeding roller which is usually lifted away from the digitizer 10 and which is lowered in response to a feeding signal to be brought into contact with the original thereon.

Figure 19:
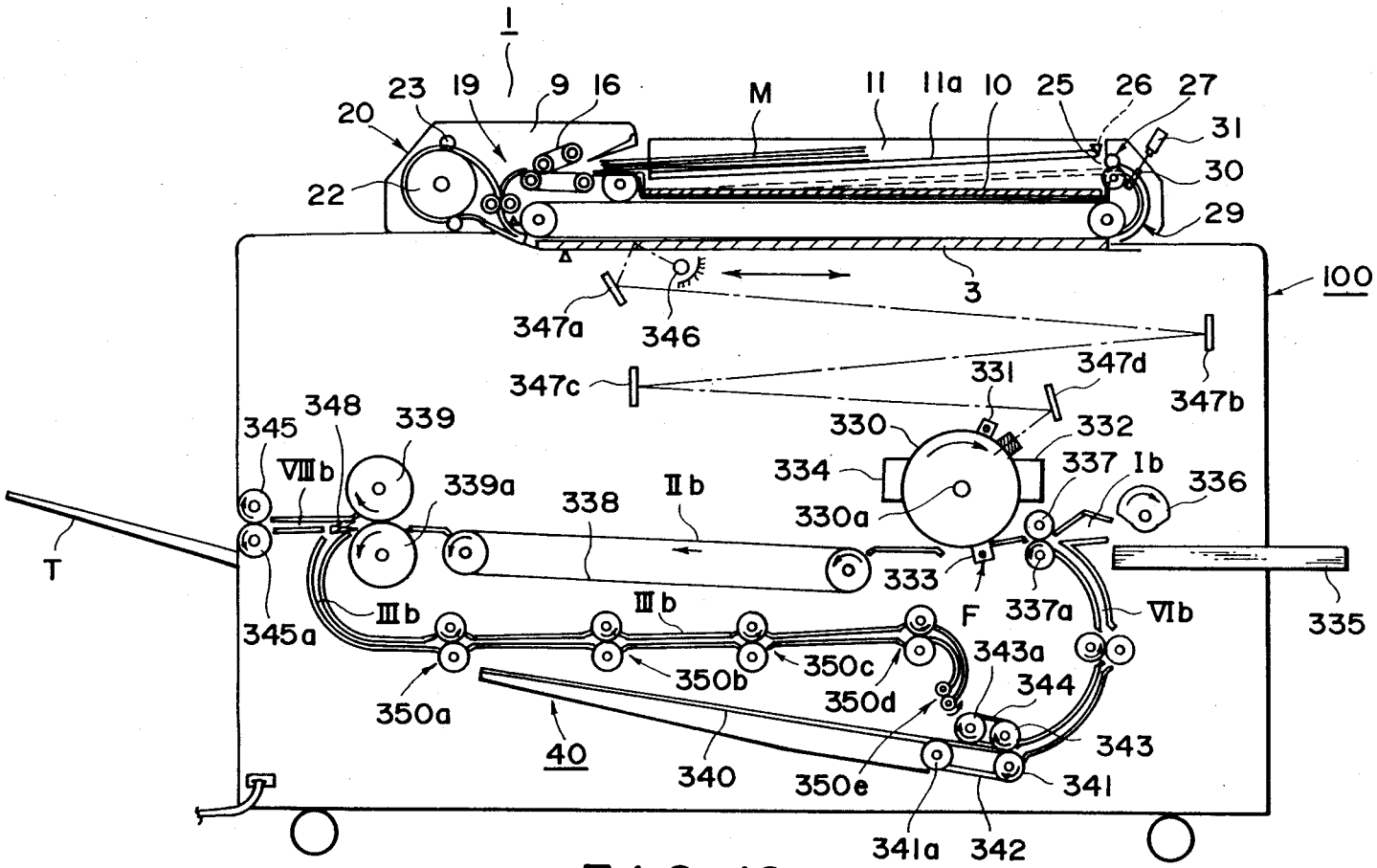
FIG. 19 is a front sectional view illustrating general arrangement of a copying machine incorporating an automatic document feeder according to the present invention.

Referring to FIG. 19, an arrangement of the mechanism for feeding copy sheets is illustrated. The detail thereof is disclosed in U.S. Pat. No. 4,761,001, issued Aug. 2, 1988.

The duplex copying apparatus comprises a platen glass 3, a photosensitive drum 330 rotatable about a shaft **330*a* in the direction shown by an arrow, a charger 311, developing device 332, a transfer charger 333, a cleaning device 334, a cassette 335 for storing the copy materials such as copy sheets, a feeding roller 336 for feeding one by one copy sheets in the cassette 335, register rollers 337 and 337*a*, and a conveyer belt 338 for conveying the copy sheet to a fixing device having rollers 339 and 339*a* after the image is transferred onto the copy sheet. The apparatus further comprises an interim tray 340 for tentatively depositing a simplex copy, a driving shaft 341 and a driven shaft 341*a* of a feeding belt 342, a driving shaft 343 an a driven shaft 343*a* of a separating belt 344 to re-feed the simplex copy sheets deposited on the interim tray 340 from the bottom. The apparatus further includes discharging rollers 345 and 345*a*** for discharging the copy sheets after completion of the copying operation to a tray T, or to proper bins of sorter not shown, if the sorter is equipped.

The movement of a copy sheet will be described. First, the description will be made as to the case where simplex copies are produced. A copy sheet is fed out of the cassette 335 by a feeding or pick-up roller 336 and then fed to a transfer station F so as to be aligned with the formed and visualized image on the photosensitive drum 330 by the register rollers 337 and **337*a*. In the transfer station, the image on the photosensitive drum 330 is transferred onto the copy sheet. The copy sheet having received the visualized image is conveyed along the sheet passageway IIb on the conveyor belt 338 to the fixing device having the rollers 339 and 339*a* where the visualized image is fixed on the copy sheet. Thereafter, the copy sheet is discharged to the tray T by the discharging rollers 345 and 345*a*** along the passageway VIIIb.

In the case of duplex copy, a guide 348 provided downstream of the fixing device is shifted to the state shown by broken lines so that the copy sheet having an image only on one side is introduced to a passageway IIIb after having passed through the fixing device. The copy sheet is inverted by passing along the passageway IIIb and then stored on an interim tray 340. Next, the copy sheet on the interim tray 340 is separated by the rotation of the belts 342 and 344 and fed out one by one from the tray 340 to a passageway VIb. The copy sheet fed to the passageway VIb is conveyed to the transfer station F into alignment with the image on the photosensitive drum 330 by the same register rollers 337 and **337*a*. In the transfer station, the visualized image on the photosensitive drum 330 is transferred onto the second side of the copy sheet. The copy sheet then passes along the passageway IIb, and the image on the second side is fixed so that the copies are formed on the both sides of the copy sheet, and the copy sheet is discharged to the tray T. Along the passageway IIIb, there are provided couples of rollers 350*a*, 350*b*, 350*c* and 350*d* to properly convey the copy sheet and a couple of rollers 350*e* for discharging the copy sheet to the interim tray 340**.

Figure 20:
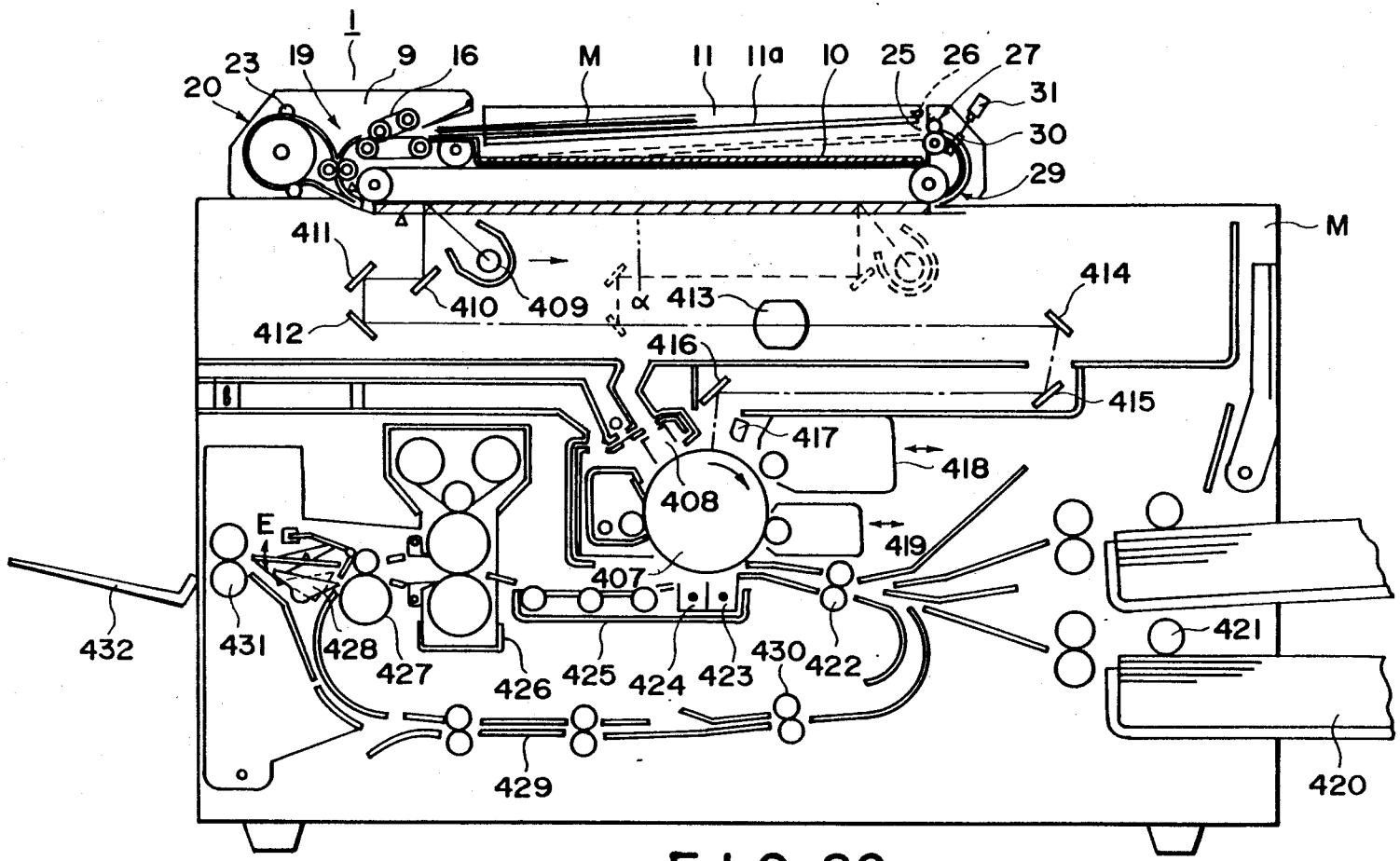
FIG. 20 is a sectional front view of an image forming apparatus according to another embodiment of the present invention.
Figure 21B:
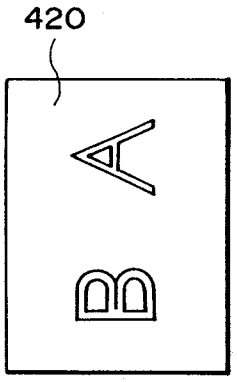
FIG. 21B is a top plan view of a copy on which an image is formed.
Figure 21A:
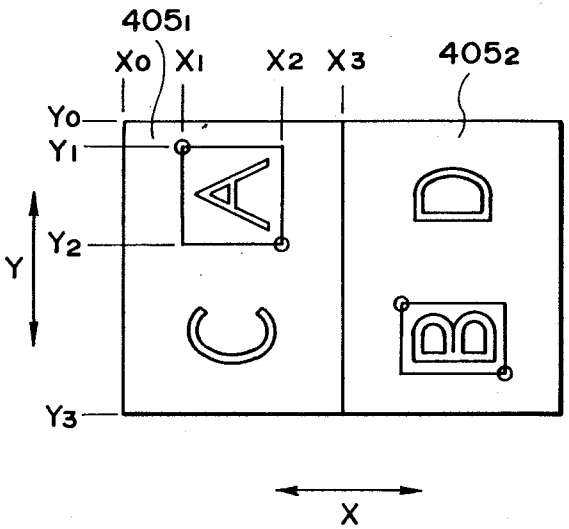
FIG. 21A is a top plan view illustrating designation of a copy or reading area of an original.

FIG. 20 is a sectional view of the second embodiment of the present invention and the construction and mode of operation of the second embodiment will be described further in detail with reference to FIGS. 20–21B when a plurality of image patterns from a plurality of originals are reproduced in color on a single copy sheet by designating desired image areas to be copied (U.S. Ser. No. 900,741). An original 405 to be copied contains original $405_1$ and $405_2$ which have patterns as shown in FIG. 21A. It is assumed that the pattern "A" of the original $405_1$ is selected and is to be copied in black, while the pattern "B" of the original $405_2$ is selected and is to be copied in red. To this end, the operator depresses a button or buttons on an operation panel so that the multi-image copying operation, the color copying operation and the operation for designating a desired image area to be copied may be accomplished simultaneously. Next, the operator pushes a selection button in order that a red image pattern may be obtained in the second copying process. (In general, a black copy is automatically selected in the first copying process, but it is possible to obtain a copy in another color other than black in the first copying process).

The original is first placed on the digitizer 10 as shown in FIG. 21A and the operator presses with the input pen two points ($X_1$, $Y_1$) and ($X_2$, $Y_2$) which are indicated by white dots and are at the opposite ends, respectively, of a diagonal line, whereby an area of the pattern A is designated. In a similar manner, the area of the pattern B of the original $405_2$ is designated. Thereafter, the original $405_1$ and $405_2$ are placed on the original supporting platen 3 in juxtaposed relationship with each other. This can be performed by, for example, constructing the device such that the first original is once stopped when the trailing edge thereof is going to leave the nip of the rollers and that the second sheet is inserted manually into the nip of the rollers then at rest, and subsequently the rollers are rotated.

Upon depression of the copy-start button on the operation panel, a charger 408 uniformly charges the cylindrical surface of a photosensitive drum 407 which rotates in the direction indicated by an arrow (see FIG. 20). Concurrently, a projection system comprising a lamp 409 and mirrors 410, 411 and 412 starts the exposure scanning of the original $405_1$. After scanning the original $405_1$ to the position indicated by the two-dot chain lines $\alpha$. The projection system is returned to its original or home position. The pattern scanned by this projection system is transmitted through a lens 413 and mirrors 414, 415 and 416 to the photosensitive drum 407, whereby the electrostatic image of the original $405_1$ is formed on the cylindrical surface of the photosensitive drum 407. Reference numeral 417 designates an array of light-emitting elements such as LEDs disposed in the direction in parallel with the axis of the photosensitive drum 407 (that is, in the direction perpendicular to the drawing of FIG. 20). In response to the signal for designating a desired image area, the light-emitting elements 417 are partly turned on in the Y direction and time-serially turned on in the X direction in FIG. 21A. As a result, the cylindrical surface except the designated image area A of the photosensitive drum is exposed to light so that the area except the desired image area of the cylindrical surface of the photosensitive drum 407 is discharged. This means that even when the original $405_1$ is projected to the cylindrical surface of the photosensitive drum 407, no electrostatic image other than the desired image pattern A is formed (the electrostatic image of the pattern C is not formed). Reference numeral 418 depicts a red developing device; and 419, a black developing device. Both the red and black developing devices are so disposed that they move toward or away from the photosensitive drum 407 as indicated by the double-pointed arrows. In FIG. 20, the red developing device 418 is moved away from the photosensitive drum 407 while the black developing device 419 is positioned adjacent to the cylindrical surface of the photosensitive drum 407. Therefore, the electrostatic image of the pattern A is developed in black and the black toner image becomes visible.

Meanwhile, a copy sheet 420 is fed by a feed roller 421 into the copying apparatus, and its leading edge is clamped by a pair of register rollers 422. When the leading edge of the original is aligned with the leading edge of the copy sheet, the register rollers 422 are rotated so that the copy sheet 420 is fed toward the photosensitive drum 407 so that the black toner image is transferred by a transfer charger 423 on the copy sheet 420, which in turn is separated from the photosensitive drum 407 by means of a separating charger 424. Thereafter, the copy sheet 420 is transferred through a transferring section 425 to a fixer 426, whereby the black toner image is fixed to the copy sheet 420. The copy sheet 420 is transported toward a first copy sheet discharge roller 427, but since the multi-image copying operation is selected, a flapper 428 which is disposed immediately after the roller 427 is brought to the position indicated by the broken lines by a driving means (not shown) so that the copy sheet 420 passes past the first discharge roller 427 and directed by the flapper 428 to a lower copy sheet transportation section 429. When the leading edge of the copy sheet 420 reaches lateral register rollers 430, it is gripped or clamped by the rollers 430 so that the copy sheet 420 is held stationary. At this time, the flapper 428 is returned to its normal position indicated by the solid lines. Concurrently the black developing device 419 is moved away from the photosensitive drum 407 while the red developing device 418 is brought to a position adjacent to the cylindrical surface of the photosensitive drum 407.

Thereafter, the projection system comprising the lamp 409 and the mirrors 410 411 and 412 are shifted, temporarily stopped at the position $\alpha$ and then disposed again to the position indicated by the broken lines, whereby the exposure scanning of the original $405_2$ is completed. Then, the projection system is returned to its home position indicated by the solid lines. Therefore, the image of the originals $405_2$ is projected on the cylindrical surface of the drum 407, but in response to the signal for designating a desired image area to be copied, the light-emitting elements 417 are turned on and off in a manner substantially similar to that described above with reference to the projection of the image of the original $405_1$ on the photosensitive drum 407 so that the electrostatic images of the patterns (in this case, pattern D) is not formed and only the electrostatic image of the pattern B is formed on the cylindrical surface of the photosensitive drum 407. The electrostatic image B on the photosensitive drum 407 is developed by the red developing device 415, while the lateral register rollers 430 are rotated so that the copy sheet 420 is transported toward the register rollers 422. The lateral register rollers 430 are so designed and constructed that while they rotate, they are shifted in the direction perpendicular to the direction in which the copy sheet 420 is transported. Therefore, while the copy sheet 420 is fed by the lateral register rollers 30 toward the register rollers 422. It is displaced in the direction perpendicular to the direction in which the copy sheet 420 is transported, whereby the position of the copy sheet 420 in the direction perpendicular to the direction in which the copy sheet 420 is transported is corrected to become the same as that when the original $405_1$ is projected on the photosensitive drum 407. Thereafter, the red toner image is transferred to the copy sheet 20 in a manner substantially similar to that described above with reference to the reproduction of the pattern A on the original 405$_1$ and after passing past the first discharge roller 427, the copy sheet 420 is guided by the upper edge of the flapper 428 which is held in position indicated by the solid lines, toward a pair of second discharge rollers 431 from which the copy sheet 420 is discharged into a tray 432. Thus, multi-color images as shown in FIG. 21B are reproduced on the copy sheet 20.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus with an automatic document feeder, comprising:

original supporting means for supporting an original, said original supporting means being provided with a digitizer for designating such an area in the original as to be recorded;

original feeding means for feeding the original from the digitizer;

conveying means for conveying the original fed by said feeding means to an original reading station and thereafter discharging the original from the reading station;

a sheet inverting passage for inverting in face orientation the original;

control means for controlling upon a duplex digitizer mode said conveying means to inverse in a face orientation the original through said inverting passage and then to discharge it to the digitizer;

copy sheet feeding means;

image forming means;

discharging means for discharging the copy sheet having an image formed thereon by said image forming means;

intermediate tray means for accommodating the copy sheet having the formed image and refeeding it to said image forming means; and switching means for selectively introducing the copy sheet to one of said intermediate tray and said discharging means; and second control means for controlling said switching means for introduction of the sheet to said intermediate tray upon selection of the duplex digitizer mode.

2. An automatic document feeder comprising:

first original supporting means for supporting an original, said first original supporting means being provided with a digitizer for designating such an area in the original as to be recorded;

first original feeding roller means for feeding the original from the digitizer;

second original supporting means for supporting an original;

second original feeding roller means for feeding the original from said second original supporting means;

conveying belt means for introducing the original fed by said second feeding roller means to an original reading station on a platen glass and thereafter discharging the original from the reading station;

a sheet inverting passage for inverting in face orientation the original discharged from the reading station by said conveying belt means;

a first curved passage, disposed opposed to one end of said conveying belt means, for connecting said conveying belt means and said first original supporting means;

a second curved passage, disposed opposed to another end of said conveying belt means, for connecting said conveying belt means and said second original supporting means; and control means for introducing the original to the reading station through said first original feeding roller means and said conveying belt means and then discharging it from the reading station by said conveying belt means upon a simplex digitizer mode, and for introducing the original to the reading station through said first original feeding roller means and said conveying belt means and then discharging it from the reading station by said conveying belt means to said inverting passage and further returning it to said first original supporting means through said conveying belt means upon a duplex digitizer mode;

wherein said platen glass, said conveying belt means, said first original supporting means and said second original supporting means are disposed in stages in the order named.

3. An image forming apparatus with an automatic document feeder, comprising:

first original supporting means for supporting an original, said first original supporting means being provided with a digitizer for designating such an area in the original as to be recorded;

first original feeding means for feeding the original from the digitizer;

second original supporting means for supporting an original;

second original feeding means for feeding the original from said second original supporting means;

conveying means for introducing the original fed by said second feeding means to an original reading station and thereafter discharging the original from the reading station;

a sheet inverting passage for inverting in face orientation the original discharged from the reading station by said conveying means;

control means for introducing the original to the reading station through said first original feeding means and said conveying means and then discharging it from the reading station by said conveying means upon a simplex digitizer mode, and for introducing the original to the reading station through said first original feeding means and said conveying means and then discharging it from the reading station by said conveying means to said inverting passage and further returning it to said first original supporting means through said conveying means upon a duplex digitizer mode;

copy sheet feeding means;

image forming means;

discharging means for discharging the copy sheet having an image formed thereon by said image forming means;

intermediate tray means for accommodating the copy sheet having the formed image and refeeding it to said image forming means; and switching means for selectively introducing the copy sheet to one of said intermediate tray an said discharging means; and second control means for controlling said switching means for introduction of the sheet to said intermediate tray upon selection of the duplex digitizer mode.

4. An automatic document feeder, comprising:

first original supporting means for supporting an original, said first original supporting means being provided with a digitizer for designating such an area in the original as to be recorded;

first original feeding means for feeding the original from the digitizer;

second original supporting means for supporting an original;

second original feeding means for feeding the original from said second original supporting means;

conveying means for introducing the original fed by said first or second feeding means to an original reading station and thereafter discharging the original from the reading station;

a sheet inverting passage for inverting in face orientation the original discharged from the reading station by said conveying means; and control means for introducing the original to the reading station through said first original feeding means and said conveying means and then discharging it from the reading station by said conveying means upon a simplex digitizer mode, and for introducing the original to the reading station through said first original feeding means and said conveying means and then discharging it from the reading station by said conveying means to said inverting passage and further returning it to said first original supporting means through said conveying means upon a duplex digitizer mode.

5. A feeder according to claim 4, wherein said second feeding means is disposed at an opposite side of the reading station from said first feeding means.

6. A feeder according to claim 5, wherein said second original supporting means is disposed above the reading station and communicates with the reading station through a curved inversing passage.

7. A feeder according to claim 6, wherein said first original supporting means is disposed above the reading station and communicates with the reading station through a curved inversing passage.

8. A feeder according to claim 7, wherein the curved inversing passage guides the original being discharged to the digitizer.

9. An automatic document feeder, comprising:

a first original supporting means for supporting an original, said first original supporting means being provided with a digitizer for designating such an area in the original as to be recorded;

first original feeding means for feeding the original from the digitizer;

second original supporting means for supporting an original;

second original feeding means for feeding the original from said second original supporting means;

conveying means for introducing the original fed by said first or second feeding means to an original reading station and thereafter discharging the original from the reading station;

control means for controlling said conveying means to inverse in a face orientation the original fed by the first feeding means and then to discharge it to said digitizer, while to inverse in a face orientation the original fed by said second feeding means and then to return it to the reading station;

cover means, mounted to said second original supporting means, for covering the digitizer, said cover means being movable between a covering position where it covers the digitizer and an open position where the digitizer is opened; and means, associated with said cover means, for placing an end of the digitizer in substantial alignment with an inlet to said first feeding means when said cover means is at the open position, while shifting the end away from the inlet.

10. A feeder according to claim 9, wherein the digitizer is pivotably supported adjacent an end opposite to the aforementioned first end, and includes spring means for normally urging the first end upwardly and is maintained at a downward position by said placing means when the cover means takes its closing position.

11. A feeder according to claim 10, wherein an end of said second original supporting means is faced to an inlet to said second feeding means, when the cover means is at its closed position.

12. A feeder according to claim 11, wherein said second feeding means is disposed at an opposite side of the reading station from the first feeding means.

13. A feeder according to claim 12, wherein said second original supporting means is disposed above the reading station and communicates with the reading station through a curved inversing passage.

14. A feeder according to claim 13, wherein said control means includes a sheet inversing mechanism for inversing the original, the inversing mechanism being disposed at an opposite side of the reading station from said first feeding means.

15. A feeder according to claim 14, wherein said control means reverses original feeding directions of said conveying means and first feeding means.

16. A feeder according to claim 15, wherein said first original supporting means is disposed above the reading station and communicates with the reading station through a curved inversing passage.

17. A feeder according to claim 16, wherein the curved inversing passage guides the original being discharged to the digitizer.

* * * * *

UNITED STATES PATENT AND TRADEMARK OFFICE

CERTIFICATE OF CORRECTION

PATENT NO. : 4,935,775

DATED : June 19, 1990

INVENTOR(S) : NORIYOSHI UEDA, ET AL.

It is certified that error appears in the above-identified patent and that said Letters Patent is hereby corrected as shown below:

Drawings

SHEET 9 OF 12

FIG. 18, "SUPERINPOSING" should read --SUPERIMPOSING-- and "DEGITIZER" should read --DIGITIZER--.

COLUMN 4

Line 7, "glass" should read --glass 3)--.
Line 53, "digitizer" should read --digitizer 10--.

COLUMN 5

Line 6, "projection 43" should read --projection 45--.

COLUMN 7

Line 37, "it" should read --is--.

COLUMN 8

Line 14, "an" should read --and--.

UNITED STATES PATENT AND TRADEMARK OFFICE

CERTIFICATE OF CORRECTION

PATENT NO. : 4,935,775

DATED : June 19, 1990

INVENTOR(S) : NORIYOSHI UEDA, ET AL.

It is certified that error appears in the above-identified patent and that said Letters Patent is hereby corrected as shown below:

COLUMN 13

Line 2, "an" should read --and--.

Signed and Sealed this

Seventh Day of July, 1992

*Attest:*

DOUGLAS B. COMER

*Attesting Officer*

*Acting Commissioner of Patents and Trademarks*